US006584922B1

(12) United States Patent
Fritz et al.

(10) Patent No.: US 6,584,922 B1
(45) Date of Patent: Jul. 1, 2003

(54) PORTABLE BOAT LIFT

(76) Inventors: Eugene L. Fritz, 1250 Ogden Rd., Venice, FL (US) 34293; Eugene Miller, 1250 Ogden Rd., Venice, FL (US) 34293

( * ) Notice: Subject to any disclaimer, the term of this patent is extended or adjusted under 35 U.S.C. 154(b) by 0 days.

(21) Appl. No.: 10/154,736

(22) Filed: May 23, 2002

(51) Int. Cl.[7] ..... B63C 7/00
(52) U.S. Cl. ..... 114/44; 114/48; 405/3
(58) Field of Search ..... 114/44–48, 50, 114/51, 365–372; 405/1, 3, 4, 7, 218, 221; 280/414.1; 414/678

(56) References Cited

U.S. PATENT DOCUMENTS

| | | | | |
|---|---|---|---|---|
| 1,284,277 | A | 11/1918 | Ewig et al. | 212/299 |
| 2,419,813 | A | 4/1947 | Berchtold | 187/244 |
| 3,077,742 | A | 2/1963 | Brown | 405/3 |
| 3,169,644 | A | 2/1965 | Godbersen | 414/680 |
| 3,284,052 | A | 11/1966 | Godbersen | 405/3 |
| 3,697,048 | A | 10/1972 | Sarno | |
| 3,747,778 | A | 7/1973 | Collins, Jr. | 414/678 |
| 3,753,355 | A | 8/1973 | Knoch | 405/3 |
| 4,019,212 | A | 4/1977 | Downer | 114/361 |
| 4,787,327 | A | 11/1988 | Porter | |
| 5,051,056 | A | 9/1991 | Gibbons et al. | 414/678 |
| 5,163,378 | A | 11/1992 | Raymond | |
| 5,211,124 | A | 5/1993 | Reiser | 114/44 |
| 5,240,347 | A | 8/1993 | Williams | |
| 5,281,077 | A | 1/1994 | Phillips | |
| 5,290,124 | A | 3/1994 | Pavlescak | |
| 5,380,143 | A | 1/1995 | Mohan | 414/495 |

*Primary Examiner*—Stephen Avila
*Assistant Examiner*—Ajay Vasudeva
(74) *Attorney, Agent, or Firm*—Charles J. Prescott

(57) ABSTRACT

A portable boat lift for removal of a boat from a boat trailer comprising two elongated free-standing upright frame members and an elongated crossmember which is pivotally connectable at one end thereof to one selected aperture of one of the frame members. The crossmember includes a bow eye engaging clevis adapted for lifting engagement with a bow eye of the boat. The other frame member includes a winch with cable connectable to the other end of the crossmember. When the frame members are placed one on either side of the boat trailer adjacent the bow of the boat with the crossmember is pivotally connected to one frame member, the clevis is connected to the bow eye, and rigid support members are placed beneath the aft end of the boat, the winch will raise the boat from the trailer.

6 Claims, 5 Drawing Sheets

PORTABLE BOAT LIFT

BACKGROUND OF THE INVENTION

1. Scope of Invention

This invention is direct to boat lift apparatus and more particularly to a portable boat lift which will facilitate lifting a boat from a boat trailer and storing the boat in that situation while the trailer is serviced or otherwise removed or the boat hull is repaired.

2. Prior Art

The vast majority of boats under a length of about 26' are stored and transported on conventional boat trailers which include an elongated support bed having various boat cradle attachments particularly customized for the configuration and length of the hull of the boat. The boat trailer has an elongated tongue having a distal socket or cup which is connectable to a tow hitch ball attached to the frame of a tow vehicle. The normal means for removing the boat is by backing the boat trailer into the water at a boat ramp and then simply floating or launching the boat from the boat trailer.

The repeated submersion of the boat trailer, especially in contaminated and salt-water environments, will cause rapid deterioration of various components of the boat trailer, including electrical connections and writing and wheel bearings and various other pivotal members of the boat trailer itself. In order to service the boat trailer having one or more of these maintenance items requiring attention is typically done with the boat and the weight thereof remaining atop the boat trailer. The repairs and maintenance to the boat trailer are thus made quite a bit more difficult than if the boat were to be removed completely from the boat trailer.

Additionally, a proud boat owner is regularly cleaning and waxing the exterior boat surface and servicing engine components. With the boat resting atop the boat trailer, attending to the exterior needs of the lower hull of the boat is quite difficult.

A number of prior art apparatus are known to applicant which are generally directed to portable watercraft and boat lift mechanisms, some of which may be utilized to lift the boat from the trailer for either of these maintenance purposes for the boat and/or the boat trailer.

U.S. Pat. No. 5,281,077 to Phillips

U.S. Pat. No. 3,697,048 to Sarno

U.S. Pat. No. 5,163,378 to Raymond

U.S. Pat. No. 5,290,124 to Pavlescak

U.S. Pat. No. 5,240,347 to Williams, et al.

U.S. Pat. No. 4,787,327 to Porter

However, these above prior art teachings are cumbersome to deploy, expensive to manufacture and purchase and may require additional or enhanced structural features of the boat to make them compatible.

The present invention teaches a portable boat lift mechanism which, in combination with conventional stem or aft support of the hull, will easily lift the boat from a boat trailer and allow the trailer to be removed leaving the boat supported by the boat lift and the rigid aft support members. By taking advantage of the bow lift or towing eye of the trailerable boat, no further strengthening or boat attachments are required to utilize the present invention.

BRIEF SUMMARY OF THE INVENTION

This invention is directed to a portable boat lift for removal of a boat from a boat trailer comprising two elongated free-standing upright frame members and an elongated crossmember which is pivotally connectable at one end thereof to one selected aperture of one of the frame members. The crossmember includes a bow eye engaging clevis adapted for lifting engagement with a bow eye of the boat. The other frame member includes a winch with cable connectable to the other end of the crossmember. When the frame members are placed one on either side of the boat trailer adjacent the bow of the boat with the crossmember is pivotally connected to one frame member, the clevis is connected to the bow eye, and rigid support members are placed beneath the aft end of the boat, the winch will raise the boat from the trailer.

It is therefore an object of this invention to provide a portable boat lift, which is easily useable by one person for the removal of a boat from a boat trailer.

It is another object of this invention to provide a portable boat lift which is inexpensive to manufacture and may be utilized on a broad range of trailerable boat sizes and shapes to lift the boat from the boat trailer.

In accordance with these and other objects which will become apparent hereinafter, the instant invention will now be described with reference to the accompanying drawings.

DETAILED DESCRIPTION OF THE INVENTION

Figure 1:
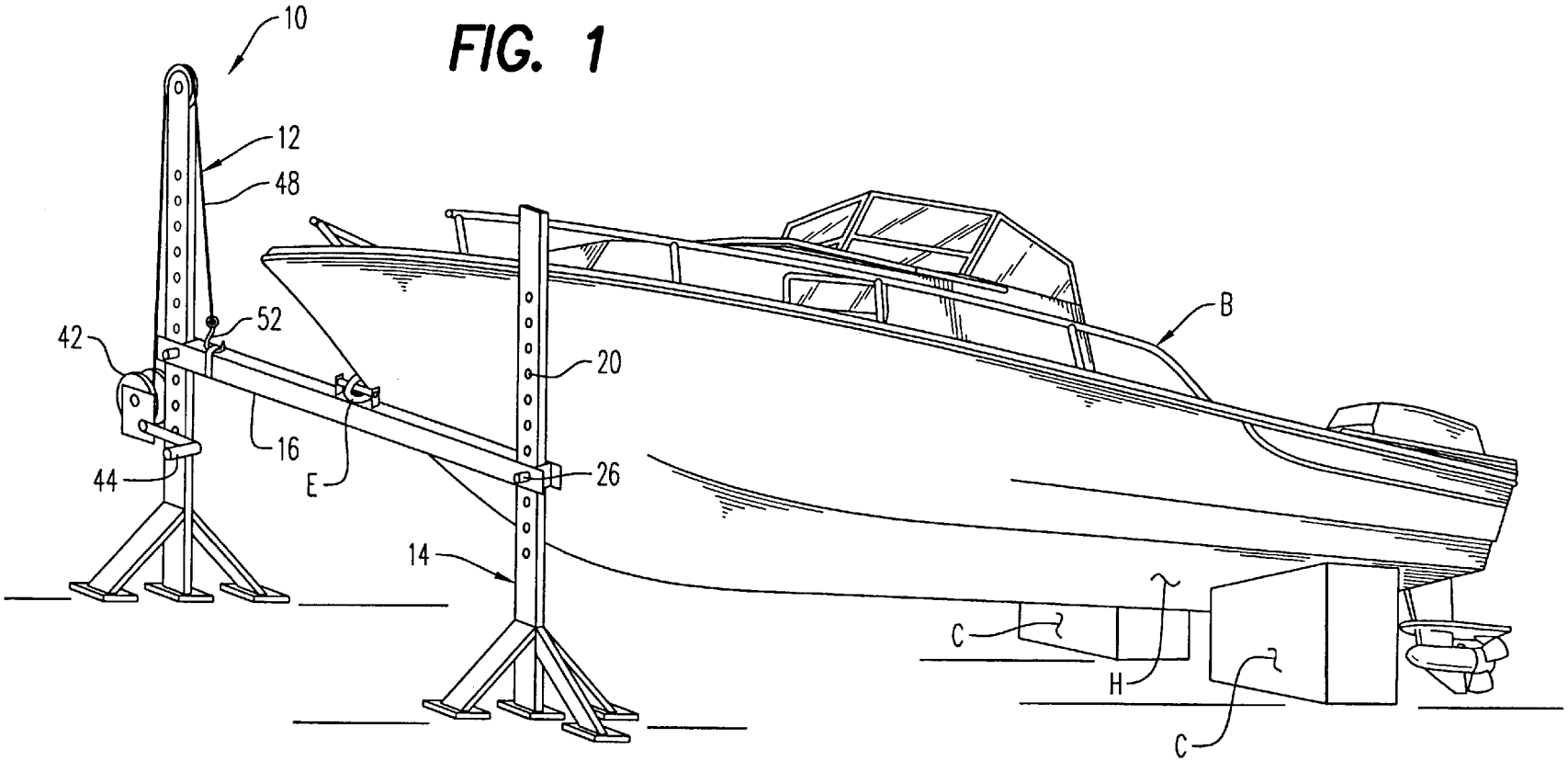
FIG. 1 is a perspective view of the invention in use in conjunction with a conventional trailerable powerboat.
Figure 2:
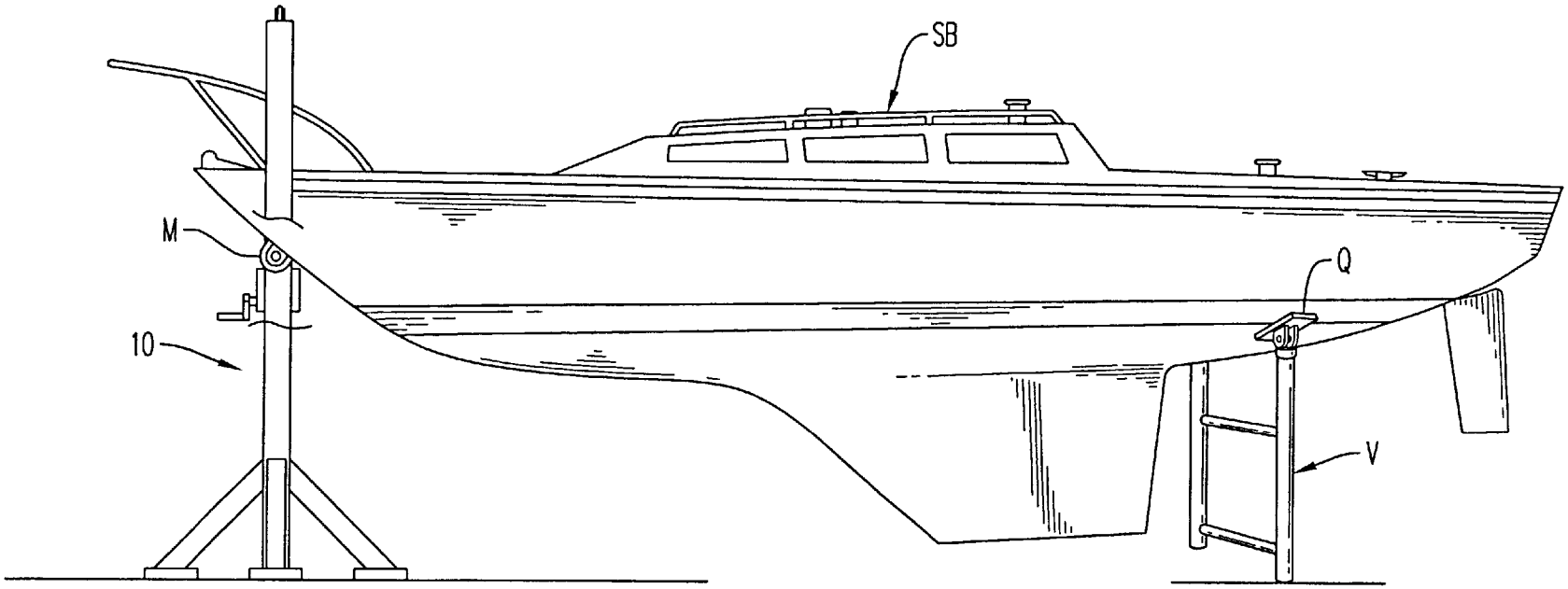
FIG. 2 is a perspective view of the invention of FIG. 1 in use in conjunction with a sailboat.
Figure 3:
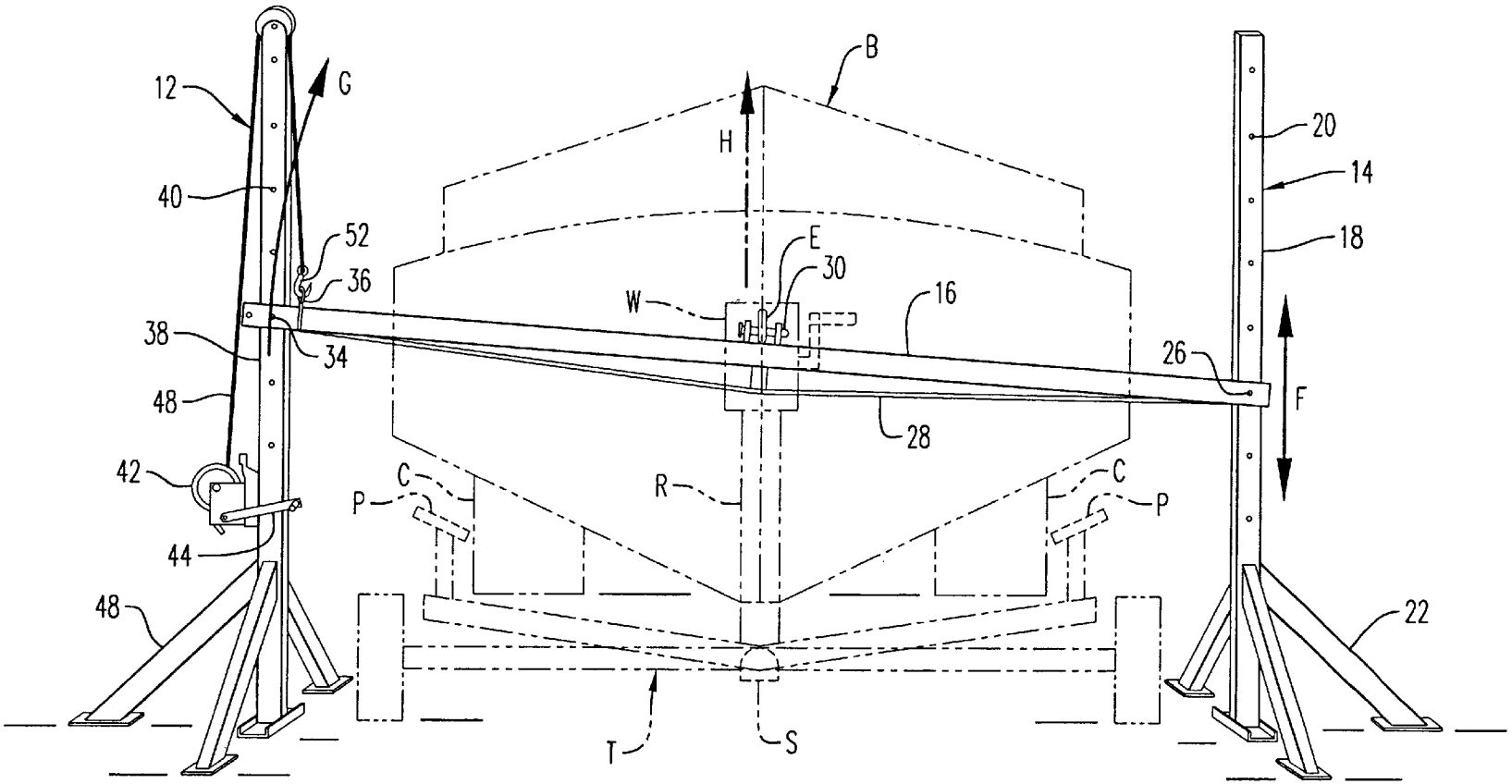
FIG. 3 is a front elevation view of FIG. 1 showing the boat atop a trailer in phantom as the boat is being lifted from the boat trailer.

Referring now to the drawings, the invention is there shown in FIGS. 1, 2 and 3, generally at numeral 10 and includes two upright free-standing frame members 12 and 14 and an elongated crossmember 16 which spans therebetween. In FIG. 1, the invention 10 is deployed at the bow of a trailerable powerboat B while, in FIG. 2, the invention 10 is deployed at the bow of a sailboat SB. Each of these vessels B and SB include a bow or towing eye E or M which is securely attached along the center line of the vessel B or SB just aft of and below the bow for towing and securing the boat to a boat trailer T (in phantom in FIG. 3) via a winch W and its cable connection (not shown), the winch W being attached to an upright frame member R of the trailer T.

Figure 4:
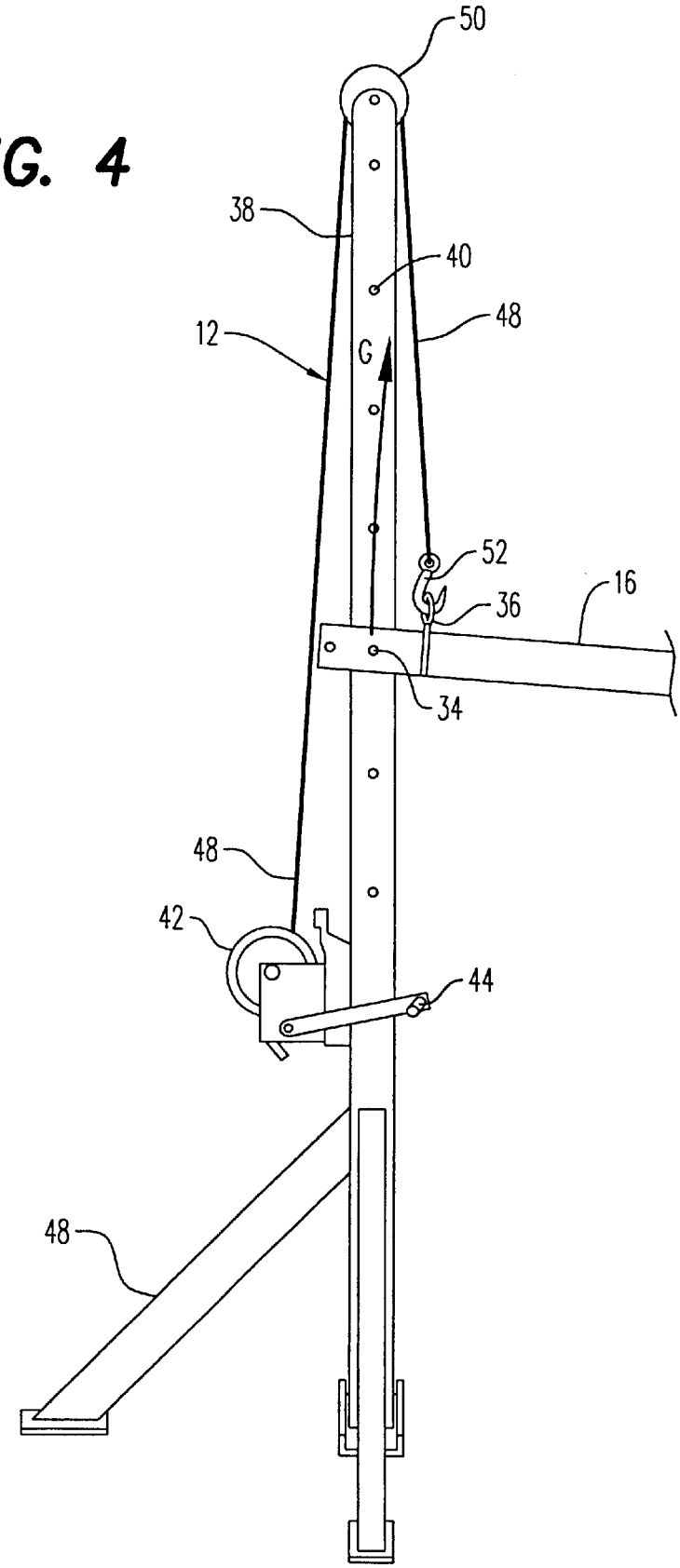
FIG. 4 is a front elevation view of one of the upright frame members (12) of FIG. 1.

Each of the upright freestanding frame members 12 and 14 includes an elongated rigid channel member 38 and 18, respectively having splayed legs shown typically at 48 and 22, respectively to provide free-standing characteristics. Each of these frame members 12 and 14, then, is positionable on either side of the bow of the boat facing one another as seen in FIGS. 1 and 2. An elongated rigid crossmember 16, which is strengthened by an elongated steel rod 28 welded to each end of the crossmember 16, adds additional strength thereto and is pivotally connected at one end thereof by a pin 26 to one of a plurality of spaced apertures 20 formed through the elongated channel member 18. The other end of the crossmember 16 includes an eye 36 as best seen in FIGS. 3 and 4 for attachment to a hook 52 secured to the end of a length of flexible cable 48. The cable 48 is operably engaged onto the spool of a manual winch 42 which is operated by a crank handle 44. The cable 48 extends over an upper roller 50 positioned at the upper end of the channel member 38 of frame member 12 as best seen in FIG. 4.

Figure 5:
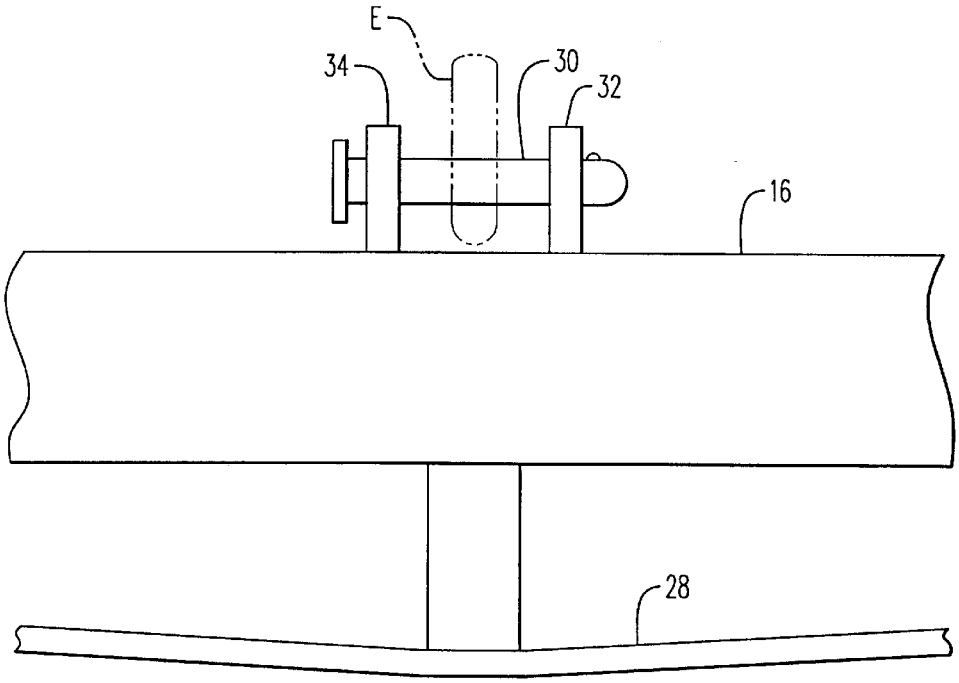
FIG. 5 is a front elevation enlarged view of the central portion of the crossmember of FIG. 1.

A clevis or shackle is formed of two upright plates or ears 32 and 34 rigidly connected to the upper surface of the central portion of crossmember 16 as best seen in FIG. 5. An elongated pin 30 slidably engages through aligned apertures formed in each of the ears 32 and 34. The entire arrangement is configured to liftingly engage with the bow eye E shown in phantom in FIG. 5.

OPERATION

By these above structural arrangements, each of the free standing frame members 12 and 14 may be positioned adjacent either side of the bow and generally in orthogonal alignment with the bow eye E or M in FIGS. 1 and 2, respectively. Thereafter, the crossmember 16 is pivotally connected by pin 26 to one of the apertures 20 along the length of the frame member 14 in the direction of arrow F. The particular aperture 20 selected is preferably one having a height above ground generally equal to that of the height of the bow eye E above ground.

Thereafter, the hook 52 at the end of cable 48 is attached to the eye 36 adjacent the other end of the cross member 16 whereupon the winch 42 is activated by the manual crank handle 44 to lift that end of the crossmember 16 upwardly in the direction of arrow G in a pivotal motion about pin 26. By this means, the bow of the boat B at the bow eye E is lifted upwardly in the direction of arrow H. A mechanical advantage of about 2:1 is also achieved reducing the strength requirements of the winch 42.

Prior to lifting the boat B, rigid support blocks C are positioned at the aft end of the boat B against the hull H. These support blocks C are typically made of Styrofoam, or as seen in FIG. 2, may be made of a tubular steel structure at V which includes hull-engaging pads Q.

As the winch 42 is activated and the end of the cross-member 16 attached to the cable 48 is pivotally moved upwardly in the direction of arrow G with the support blocks C in position, the boat B lifts entirely free of the boat trailer T and its cradle pads P so that the trailer T may be then moved by the tow vehicle (not shown) which is attached to the ball socket S of the tongue of the trailer T.

After the trailer T is removed, the winch 42 may be used to readjust the height of the boat B and, thereafter, a separate pin 34 is inserted through aligned apertures between the end of the crossmember 16 and one of the selected spaced apart apertures 40 formed through the upright frame member 12.

Should the support blocks C be sufficiently tall, the trailer tongue may be lowered slightly to position the support blocks C as shown in FIG. 1 and thereafter, the raising of the tongue and ball socket S of the trailer T will place the hull H in contact therewith. Thus, immediate activation of the winch 42 will cause the boat B to begin to lift fully from the support pads P of the trailer T.

By this arrangement, a highly portable, easily deployable and easily storable means for temporarily or long-term lifting and storing of a boat from a conventional boat trailer is facilitated. Note that the winch 42 and cable 48 arrangements may easily be replaced or substituted by other power means for lifting the corresponding end of the crossmember 16.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A portable boat lift comprising:

first and second elongated free-standing upright frame members each of which includes a plurality of spaced apertures therealong;

an elongated crossmember connectable at first and second ends thereof to one selected aperture of said first and second frame member respectively;

said crossmember including a bow eye engaging clevis positioned centrally along the length of said crossmember and being adapted for lifting engagement with a bow eye of a boat;

said first frame member also including a winch and cable, a distal end of said cable connectable to the first end of said crossmember for raising and lowering the first end of said crossmember responsive to actuation of said winch;

whereby, when said frame members are placed one on either side of a tongue of a boat trailer carrying the boat and the second end of said crossmember is pivotally connected to one selected aperture of said second frame member and said clevis is connected to the bow eye and rigid support members are placed beneath and against the aft end of the hull of the boat, activation of said winch will raise the first end of said crossmember and lift the bow of the boat from the trailer.

2. A portable boat lift as set forth in claim 1, further comprising:

a locking pin lockingly engageable between the first end of aid cross member and one selected aperture of said first frame member.

3. A portable boat lift for use in conjunction with hull support members positioned beneath the aft end of a hull of a boat resting atop a boat trailer, comprising:

first and second elongated free-standing upright frame members;

an elongated crossmember having first and second ends and being connectable at the second end thereof to one selected aperture of said second frame member;

said crossmember including a central bow eye engaging clevis adapted for lifting engagement with a bow or towing eye of a boat;

said first frame member also including a winch and cable, a distal end of said cable connectable to the first end of said crossmember for raising and lowering thereof responsive to actuation of said winch;

whereby, when said frame members are placed one on either side of a tongue of a boat trailer carrying the boat, the second end of said crossmember is pivotally connected to one selected aperture of said second frame member, said cable is attached to the first end of said crossmember, said clevis is connected to the bow eye and rigid support members are placed beneath and against the aft end of the hull of the boat, activation of said winch will raise the first end of said crossmember and lift the bow of the boat from the trailer.

4. A portable boat lift as set forth in claim 3, wherein said first frame member includes a plurality of spaced apertures therealong, further comprising:

a locking pin lockingly engageable between the first end of aid cross member and one selected aperture of said first frame member.

5. A method of lifting a boat from atop a boat trailer, the boat having a bow or towing eye used to secure the bow of the boat to the trailer comprising the steps of:

A. positioning first and second elongated free-standing upright frame members on either side of a tongue of a boat trailer carrying the boat;

B. pivotally connecting a first end of an elongated crossmember to one selected aperture along the length of said first frame member;

C. connecting a bow eye engaging clevis positioned and rigidly connected centrally along the length of said crossmember to the bow or towing eye of the boat;

D. connecting a distal end of a cable operably attached to a winch connected to said second frame member to the second end of said crossmember;

E. placing rigid support members beneath and against the aft end of the hull of the boat;

F. lifting the boat from the boat trailer by raising the second end of said crossmember responsive to actuation of said winch, the weight of the aft end of the boat being carried by the rigid support members whereupon the boat trailer may be removed from beneath the boat.

6. The method of claim 5, further comprising the steps of:

G. pin connecting said second end of said crossmember to said second frame member to transfer load from said winch to said pin.

* * * * *

UNITED STATES PATENT AND TRADEMARK OFFICE

CERTIFICATE OF CORRECTION

PATENT NO. : 6,584,922 B1
DATED : July 1, 2003
INVENTOR(S) : Eugene L. Fritz et al.

It is certified that error appears in the above-identified patent and that said Letters Patent is hereby corrected as shown below:

Column 4,
Line 35, replace “aid” with -- said --.

Column 5,
Line 2, replace “aid” with -- said --.

Signed and Sealed this

Nineteenth Day of August, 2003

JAMES E. ROGAN
*Director of the United States Patent and Trademark Office*